US006619159B2

(12) United States Patent
Galat

(10) Patent No.: US 6,619,159 B2
(45) Date of Patent: Sep. 16, 2003

(54) NUTRUNNER SAFETY SLEEVE

(76) Inventor: Donald E. Galat, 1886 Larchwood Dr., Troy, MI (US) 48083

( * ) Notice: Subject to any disclaimer, the term of this patent is extended or adjusted under 35 U.S.C. 154(b) by 40 days.

(21) Appl. No.: 09/849,019

(22) Filed: May 7, 2001

(65) Prior Publication Data

US 2002/0162421 A1 Nov. 7, 2002

(51) Int. Cl.[7] ..... B25B 21/00
(52) U.S. Cl. ..... 81/57.13; 81/57.29
(58) Field of Search ..... 81/57.11, 57.12, 81/57.13, 57.14, 57.28, 57.29, 57.3, 57.31, 180.1, 184

(56) References Cited

U.S. PATENT DOCUMENTS

| | | | | | |
|---|---|---|---|---|---|
| 5,172,612 | A | * | 12/1992 | Hansson | 81/57.13 |
| 5,211,061 | A | * | 5/1993 | Goodwin | 73/862.541 |
| 5,586,475 | A | * | 12/1996 | Wenner | 81/60 |
| 5,709,136 | A | * | 1/1998 | Frenkel | 81/57.13 |
| 6,055,887 | A | * | 5/2000 | Galat | 81/57.13 |

* cited by examiner

*Primary Examiner*—James G. Smith
(74) *Attorney, Agent, or Firm*—Charles W. Chandler

(57) ABSTRACT

A right angle nutrunner accessory having a drive spindle adapted to be coupled to the end of a socket wrench. A tubular sleeve encloses the coupling between the accessory housing and the wrench to protect the user's hand from an injury-producing pinch point.

5 Claims, 3 Drawing Sheets

NUTRUNNER SAFETY SLEEVE

BACKGROUND AND SUMMARY OF THE INVENTION

This invention is related to a safety accessory for a power-operated nutrunner, and more particularly to a nutrunner unit having a barrel-shaped sleeve for enclosing the coupling between the drive spindle and the socket head wrench.

Power-operated nutrunners are commonly used in industry for rotating a nut. Conventionally the power unit has a square drive spindle that is received in one end of a socket wrench.

A clearance sometimes exists between the drive spindle and the wrench, located closely adjacent the location of the user's hand. Many people have suffered serious injuries to their hands due to the pinching problem that exists on most nutrunner tools at this coupling.

Further, the fastening process causes the tool to vibrate so violently as to aggravate the pinch point risk.

The broad purpose of the present invention is to provide a nutrunner sleeve for enclosing the telescopic coupling between the drive spindle and the socket wrench, to provide safety, efficiency and strength to the nutrunner application. The preferred nutrunner sleeve stabilizes the socket wrench, protects bare or gloved hands from a pinch point, mounts on existing commercial power tools and is easily installed in seconds.

The preferred embodiment of the invention comprises a tubular or barrel-shaped sleeve, having one end telescopically mounted on the power unit around the drive spindle. The sleeve also carries a bearing around the drive spindle. A sufficient clearance exists between the spindle and the bearing to receive the end of the socket wrench. Consequently, both the bearing and the spindle support the wrench. Further, the coupling between the power spindle and the wrench is totally enclosed, eliminating any opening that might pinch the user's hand. In addition, the sleeve reduces the vibrating load on the coupling.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
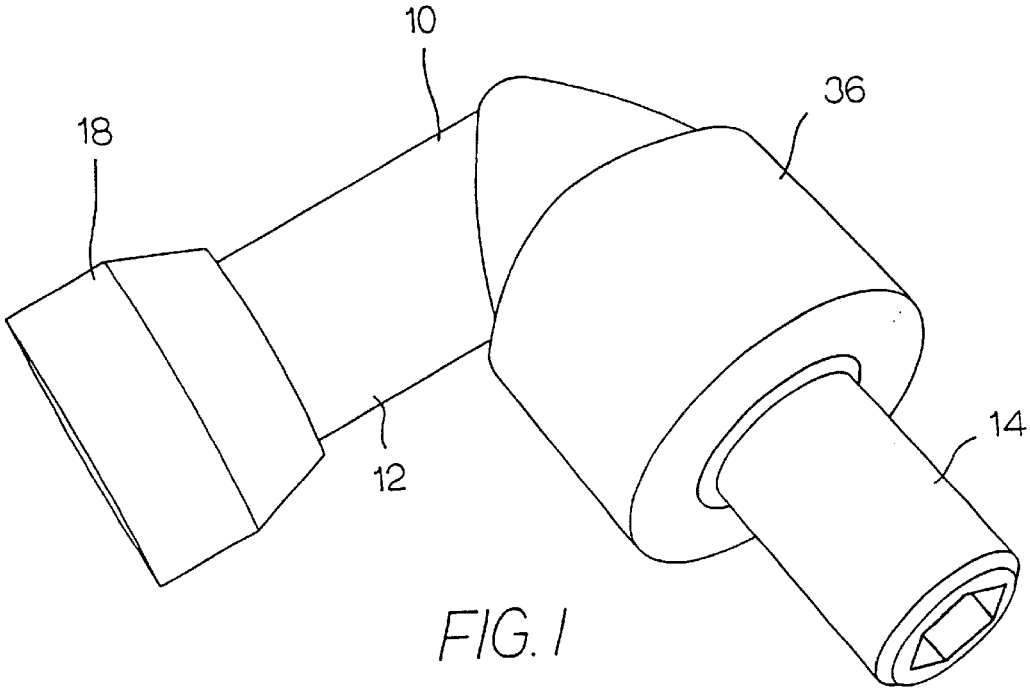
FIG. 1 is a perspective view of a right angle nutrunner having a safety sleeve illustrating the invention.
Figure 2:
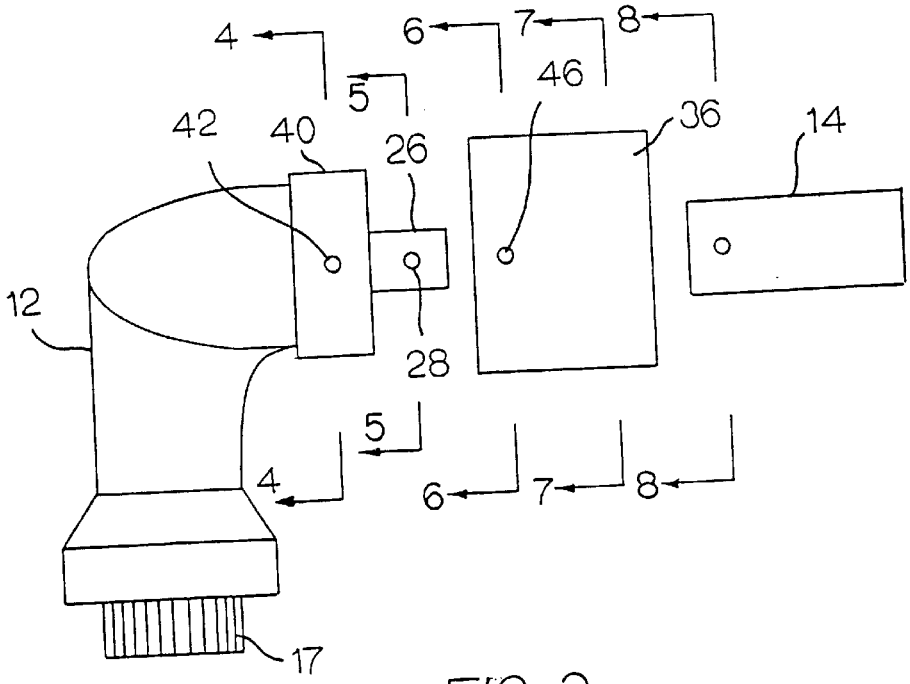
FIG. 2 is a partially exploded view of the preferred safety sleeve.
Figure 3:
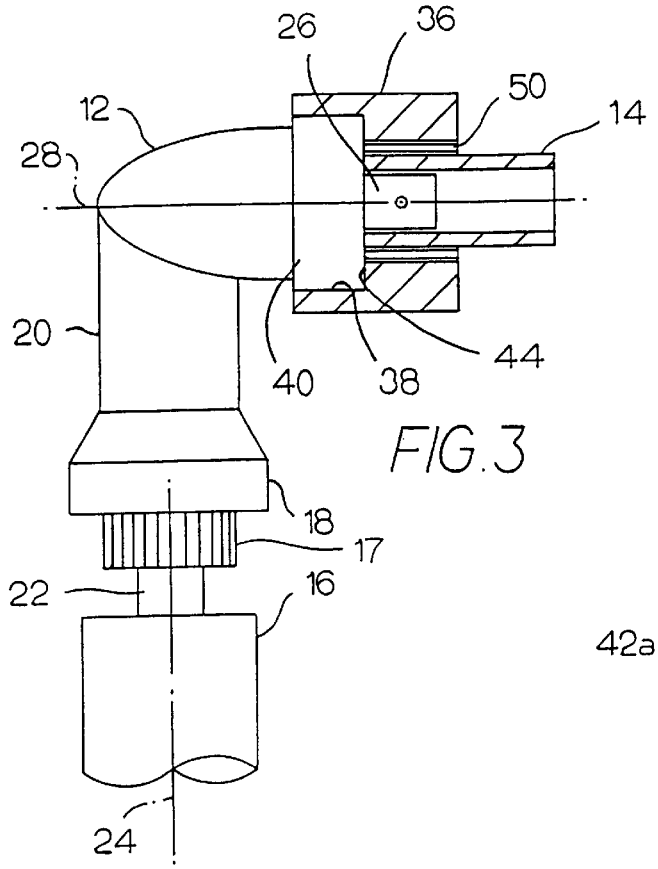
FIG. 3 is a view of the components of the safety sleeve shown partially in section.

Referring to the drawings, FIGS. 1 and 3 illustrate a pneumatic right angle nutrunner power accessory 10. Accessory 10 includes housing 12 supporting nutrunner socket wrench 14. Accessory 10 is pneumatically driven by a conventional, pneumatic power unit 16, activated when a trigger, not shown, is squeezed by the user in the conventional manner. Housing 12 has a splined end 17 telescopically connected to power unit 16 in the manner well know to those skilled in the art. A slidable, internally threaded collar 18 connects power unit 16 to housing 12.

Figure 5:
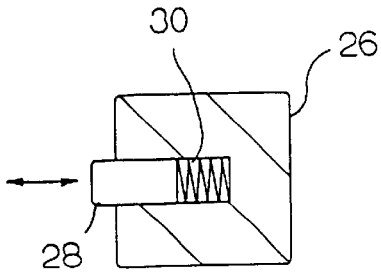
FIG. 5 is an enlarged sectional view as seen along lines 5—5 of FIG. 2.
Figure 6:
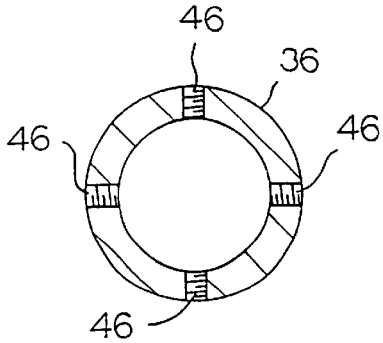
FIG. 6 is a sectional view as seen along lines 6—6 of FIG. 2.
Figure 7:
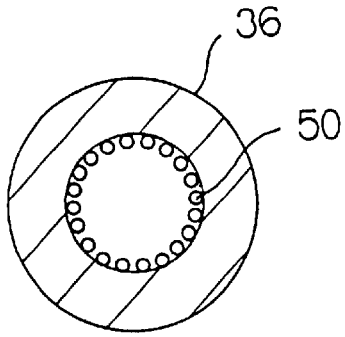
FIG. 7 is a sectional view as seen along lines 7—7 of FIG. 2.

Housing 12 supports a shaft 22, which is rotated about an axis 24. Shaft 22 is internally connected to a square drive spindle 26 for rotation about an axis 28, at right angles to axis 24. Spindle 26, as can be seen in FIG. 5, supports a detent 28, biased by an internal spring 30.

Figure 8:
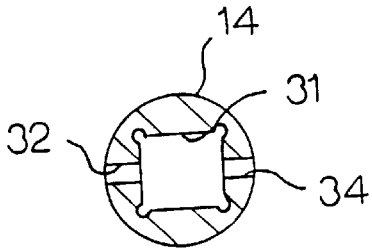
FIG. 8 is a sectional view as seen along lines 8—8 of FIG. 2.
Figure 9:
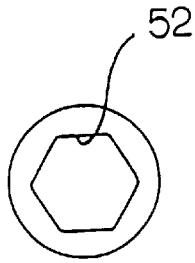
FIG. 9 is a view as seen from the right end of the nutrunner wrench as viewed in FIG. 2.

The left end of wrench 14, as viewed in FIGS. 3 and 8, has a generally square internal socket 31 that is telescopically received by spindle 26. Wrench 14 has a pair of aligned lateral openings 32 and 34, either one of which may receive detent 28 when it is depressed into the spindle and then extended to connect the spindle to the wrench for rotation.

Figure 4:
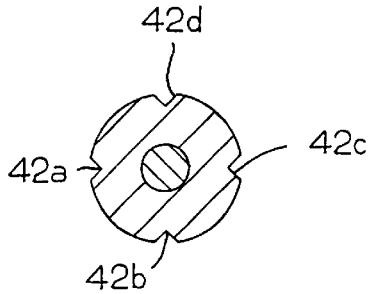
FIG. 4 is a sectional view as seen along lines 4—4 of FIG. 2.

A tubular metal sleeve 36 has a left end opening 38, as viewed in FIG. 3, with a relatively large diameter telescopically received on a collar 40 of the housing. As shown in FIG. 4, collar 40 has four recesses 42*a*, 42*b*, 42*c* and 42*d*, located at 90° intervals around collar 40. Collar 40 is sized to receive opening 38 of the sleeve to a position in which the collar abuts an internal annular wall 44. Setscrews 46 carried in four locations on the collar are received in recesses 42*a* through 42*d* to lock the sleeve on the collar.

An annular needle bearing 50 is mounted in the outer end of the sleeve and has an internal diameter adapted to receive the inner end of wrench 14 when it is coupled to the spindle. Thus, the inner end of the wrench is supported by both the spindle and needle bearing 50.

Note that the pinch point, which normally would exist between the end of collar 40 and the inner end of the wrench, is totally enclosed by the sleeve. A close fitting connection between the wrench and the needle bearing closes any pinch point that might injure the user's hand.

The outer end of the wrench, for illustrative purposes, has a hexagonal opening 52 for receiving a nut that is to be tightened or loosened.

Mounting the sleeve around the rotating drive spindle prolongs the life of the drive unit bearings, and reduces the vibration that is inherent in such tools, while protecting the user's hand.

Having described my invention, I claim:

1. A nutrunner accessory having a safety sleeve, comprising:

a drive unit housing having a rotary drive spindle (26) journalled in said housing for rotation about an axis;

said rotary drive spindle having a non-circular cross section;

a wrench having a complementary first end opening forming a socket for telescopically coupling with the drive spindle to form a telescopic coupling for conjoint rotation therewith;

said wrench having a second end opening remote from the drive unit housing;

said second end opening having non-circular internal cross section adapted to mate with a nut;

a tubular sleeve for enclosing the telescopic coupling between the drive spindle and the wrench comprising;

said sleeve having a first end telescopically connectable with said drive unit housing;

an anti-friction bearing means mounted in said sleeve for rotatably supporting said wrench;

said anti-friction bearing means being located in said sleeve, and enclosing the telescopic coupling between the wrench and the drive spindle;

whereby the wrench is supported on said spindle and said bearing means.

2. A nutrunner accessory as defined in claim 1, including threaded fastener means connecting the sleeve to the drive unit housing.

3. A nutrunner accessory as defined in claim 1, in which the drive unit housing has a first end for connecting a drive shaft rotatable about a first axis of rotation, and a second end for supporting the drive spindle about a second axis of rotation at right angles to said first axis.

4. A nutrunner accessory as defined in claim 1, in which the drive unit housing is removably connected to a pneumatic rotary power means.

5. A nutrunner accessory as defined in claim 1, including detent means for connecting the wrench to the drive spindle.

* * * * *